United States Patent [19]

Dehne

[11] Patent Number: 4,771,697

[45] Date of Patent: Sep. 20, 1988

[54] LOAD CARRIER FOR POWER AND FREE CONVEYOR

[75] Inventor: Clarence A. Dehne, Farmington Hills, Mich.

[73] Assignee: Jervis B. Webb Company, Farmington Hills, Mich.

[21] Appl. No.: 911,404

[22] Filed: Sep. 25, 1986

[51] Int. Cl.[4] ..... B61B 10/00

[52] U.S. Cl. ..... 104/89; 104/172.4

[58] Field of Search ..... 212/210, 221,.142.1; 105/149; 104/89, 93, 110, 111, 172.4; 198/680, 687

[56] References Cited

U.S. PATENT DOCUMENTS

| | | | |
|---|---|---|---|
| 3,426,700 | 2/1969 | Klamp | 104/172.4 |
| 3,926,125 | 12/1975 | Orwin | 104/172.4 |
| 4,122,778 | 10/1978 | Rosa | 104/172.4 |
| 4,341,161 | 7/1982 | Morita et al. | 104/172.4 |
| 4,389,944 | 6/1983 | Linton et al. | 104/172.4 |
| 4,408,540 | 10/1983 | Dehne | 104/172 B |
| 4,464,998 | 8/1984 | Wakabayashi | 104/172.4 |

*Primary Examiner*—Joseph F. Peters, Jr.
*Assistant Examiner*—Stephen P. Avila
*Attorney, Agent, or Firm*—Joseph W. Farley

[57] ABSTRACT

A load carrier for the carrier track of a power and free conveyor has load carrying structure comprising a front suspension member pivotally connected to a front trolley and a rear suspension member pivotally connected to a rear trolley, each suspension member having an upper portion extending transversely to one side of the track and a vertical portion extending obliquely downwardly from the upper portion through a vertical plane containing the pivotal connections. A load supporting member connects the lower ends of the suspension members and is positioned so that the center of gravity of the load carrying structure and of a load supported thereby lies in the vertical plane. A drip pan is mountable below the upper portions of the suspension members. Each carrier may include an idler trolley located intermediate the front and rear trolleys, connected to the front trolley by a tow bar, and provided with an actuating cam for operating a driving dog releasing lever on the front trolley of a following carrier for the accumulation of carriers on a portion of the conveyor having parallel tracks for the front and rear carrier trolleys.

10 Claims, 2 Drawing Sheets

LOAD CARRIER FOR POWER AND FREE CONVEYOR

SUMMARY OF THE INVENTION

This invention relates to improvements in the construction of a load carrier of a power and free conveyor having a power track supporting power means and a carrier supporting track arranged in vertically spaced relation with the power track.

Conventionally, the power means comprises an endless chain supported by trolleys mounted on the power track, and longitudinally spaced pushers carried by the chain. Each pusher is engageable with a driving dog on the front end of a load carrier, and disengaging means associated with the driving dog is operable by actuating means on the rear end of a preceding load carrier so that successive load carriers can automatically accumulate behind a stopped load carrier.

The invention is particularly directed to improvements in a load carrier adapted to transport an elongated load requiring a pair of load supporting trolleys mounted on the carrier supporting track. Representative examples of such load carriers are shown in U.S. Pat. Nos. 3,426,700 and 4,341,161. In general, the invention provides, for such a load carrier, a greatly simplified load supporting structure which both decreases the cost of the load carrier and increases the accessability of a load being transported for processing operations thereon; and, which permits the installation of sanitary protection for the load against contaminents from the conveyor chain and trolleys. Also, the invention provides for a minimum spacing between accumulated load carriers in both in-line relation on a single carrier supporting track and side-by-side relation on a pair of parallel carrier supporting tracks.

A load carrier, constructed in accordance with the invention for a conveyor having a longitudinally extending track, includes a front trolley and a rear trolley mounted on the track and load carrying structure suspended from the front and rear trolleys. The load carrying structure comprises a front suspension member, a rear suspension member, and connecting means pivotally attaching the front and rear suspension members to the corresponding one of the front and rear trolleys for movement on front and rear vertical axes centered transversely with the track. Each of the front and rear suspension members has an upper portion extending transversely of the track to the same side of a vertical plane through the vertical axes, and a vertical portion extending downwardly from the upper portion in oblique, intersecting relation with the vertical plane, and terminating in a lower end. Load supporting means connects the lower end of the front suspension member to the lower end of the rear suspension member and is positioned in part on the side of the vertical plane opposite to the upper portions of the suspension members so that the center of gravity of the load carrying structure lies substantially in the vertical plane.

Preferably, the load supporting means comprises a single longitudinal member or beam connected to and extending between the lower ends of the front and rear suspension members, and suitable load supports carried by the longitudinal member, the load supports being arranged so as to position the center of gravity of the load in the vertical plane.

For sanitary protection of the load, a conventional drip pan is mounted below the carrier supporting track and extends longitudinally thereof. The drip pan projects through the vertical plane of the load supporting structure below the upper portion of the front and rear suspension members and has a free longitudinal edge spaced transversely from the vertical portion of the front and rear suspension members.

Accumulation of load carriers at minimum spacing in both in-line and side-by-side relation is accomplished by providing each load carrier with an idler trolley which is connected to the front trolley by a tow bar and is located intermediate the front and rear trolleys of the load carrier. For in-line accumulation, actuating means on the rear trolley of each load carrier is adapted to operate driving dog disengaging means on the front trolley of a following load carrier. On a portion of a conveyor having first and second parallel carrier supporting tracks, the front and idler trolleys of each load carrier travel on the first such track, which is positioned in vertically spaced relation with a power track, and the idler trolley of each load carrier is provided with actuating means adapted to operate the driving dog releasing means on the front trolley of a following load carrier. The rear trolley of each load carrier travels on the second of such parallel carrier supporting tracks.

Other features and advantages of the invention will appear from the description to follow of the embodiment shown in the accompanying drawings.

DETAILED DESCRIPTION

Figure 1:
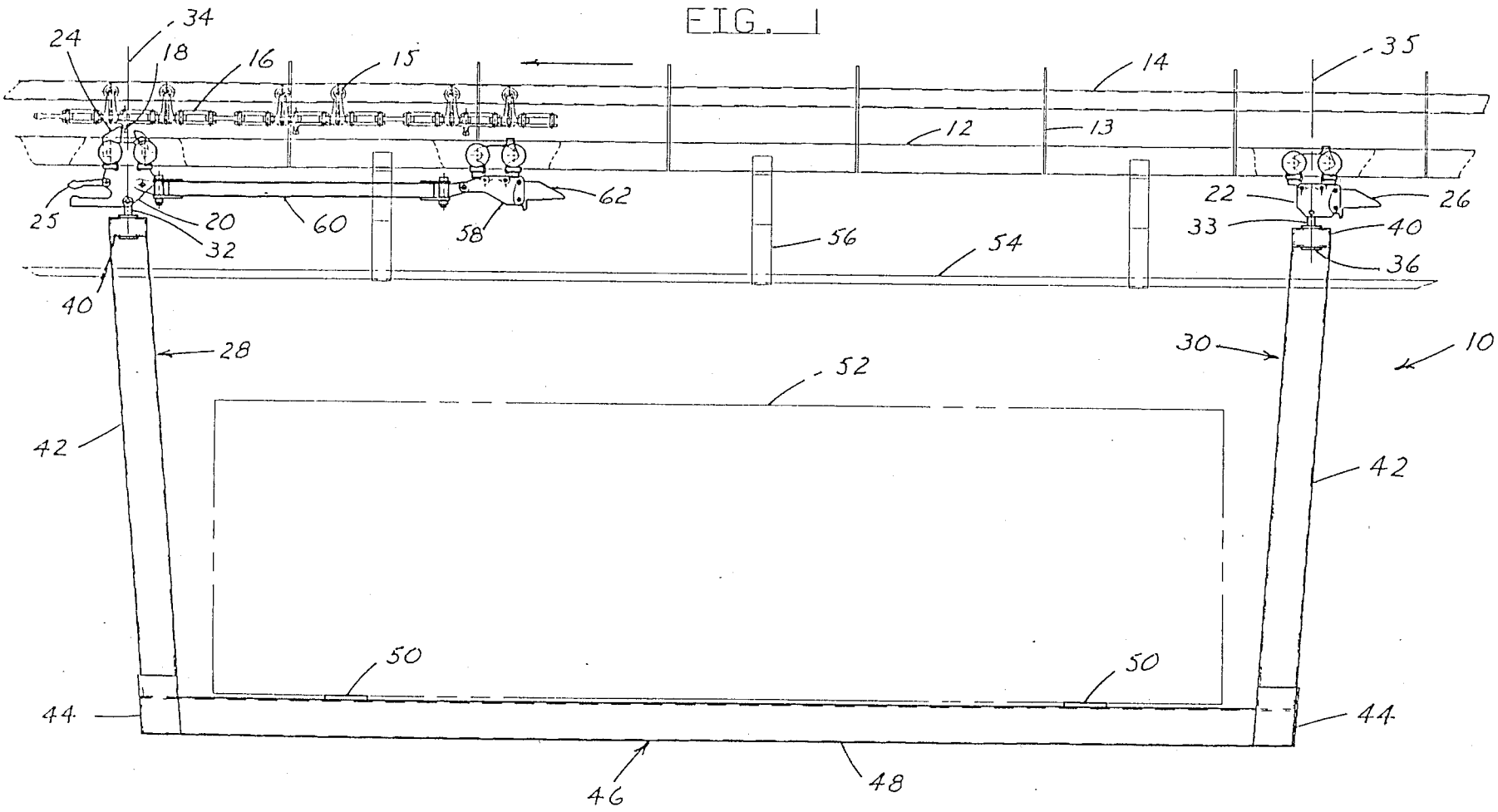
FIG. 1 is a side elevation showing a load carrier of the invention on the carrier supporting track of a power and free conveyor.

In FIG. 1, a load carrier 10 of the invention is shown mounted on a longitudinally extending carrier supporting track 12 of an overhead power and free conveyor, the track 12 being positioned by brackets 13 in vertically spaced relation with a power track 14 which supports power means comprising trolleys 15 connected to an endless driven chain 16 equipped with longitudinally spaced pushers 18. The load carrier 10 includes a front trolley 20 and a rear trolley 22, the front trolley 20 having a driving dog 24 engageable by a pusher 18 and disengageable therefrom by operation of a pivoted lever 25, the rear trolley 22 having actuating means 26 for operating the disengaging lever 18 on the front trolley of a following carrier. The foregoing components are known and hence are not shown in greater detail.

Figure 2:
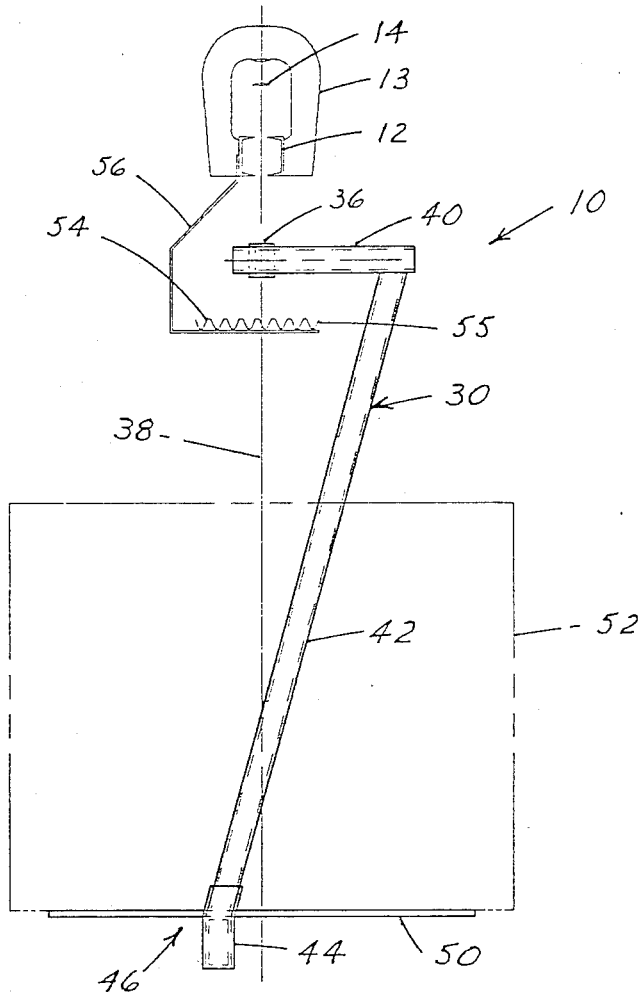
FIG. 2 is an end elevation of the load carrier of FIG. 1 with conventional components of the conveyor not shown.

Load carrying structure of the load carrier 10 is suspended from the front trolley 20 and the rear trolley 22, and as shown in FIGS. 1 and 2, comprises a front suspension member 28 and a rear suspension member 30 pivotally attached to the corresponding one of the trolleys 20 and 22 by a front connecting pin 32 and a rear connecting pin 33 defining front and rear vertical axes 34 and 35 about which the suspension members 28 and 30 are respectively movable. As best shown in FIG. 2, each of the connecting pins 32 and 33 extends through a socket or fitting 36 in the respective suspension member, the vertical axes 33 and 34 are transversely centered with the carrier supporting track 12, and the vertical axes 33 and 34 define a vertical plane indicated by the broken line 38.

Also as best shown in FIG. 2, each of the front and rear suspension members has an upper portion 40 extending transversely of the carrier track 12 to the same side of the vertical plane 38, and a generally vertical portion 42 which is secured to the upper portion 40, extends downwardly therefrom in oblique, intersecting relation with the vertical plane 38, and terminates in a lower end 44.

Load supporting means 46 connects the lower end of the front suspension member 28 to the lower end of the rear suspension member 30. The load supporting means 46 must necessarily be designed to suit the physical characteristics of a particular load to be transported and hence may differ from the specific structure shown. However, the load supporting means 46 will be positioned at least in part on the side of the vertical plane 38 opposite to the upper portions 40 of the suspension members 28 and 30 so that the center of gravity of the load supporting structure, consisting of the suspension members 28 and 30 and the load supporting means 46, lies substantially in the vertical plane 38. For example, in the construction shown, the lower ends 44 of the suspension members 28 and 30 are located on the opposite side of the vertical plane 38 from the upper portions 40, are connected by a longitudinal member 48 extending between the ends 44, and load supports 50 are attached to the member 48. This structure is designed to balance the mass of the suspension members on the other side of the vertical plane 38 and the load supports 50 are arranged so as to position the center of gravity of a load 52 carried thereby substantially in the vertical plane 38. The load carrier 10 is thus transversely balanced in a loaded condition and in an unloaded condition.

Sanitary protection for the load 52 can be provided by a drip pan 54 which is mounted below the carrier supporting track and extends longitudinally thereof. Such a drip pan is known per se; however, the provision thereof has conventionally required that each carrier be equipped with special, C-shaped suspension brackets, as shown in U.S. Pat. No. 3,426,700, for clearance with the drip pan. In the present construction, FIG. 2, the drip pan 54 extends transversely through the vertical plane 38 below the upper portions 40 of the suspension members 28 and 30 and terminates in a free longitudinal edge 55 which is spaced transversely from the vertical portions 42 of the suspension members 28 and 30. Supporting brackets 56 for the drip pan are attached to the carrier supporting track 12 on the side of the vertical plane 38 opposite to the upper portions 40 of the suspension members 28 and 30.

Figure 3:
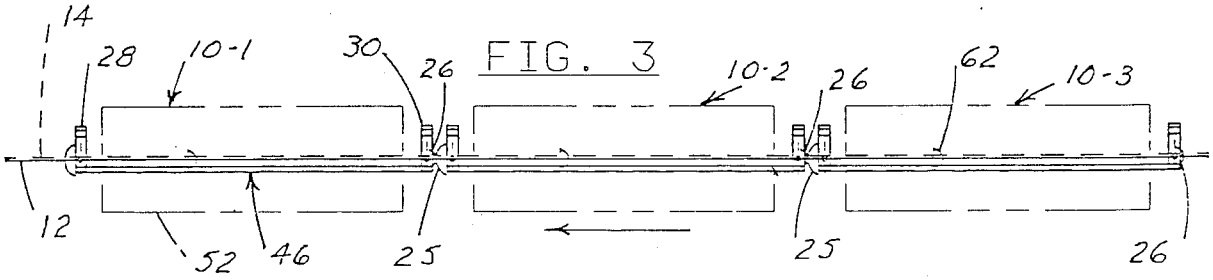
FIG. 3 is a schematic plan view showing load carriers of FIGS. 1 and 2 in in-line accumulated relation.

FIG. 3 illustrates the in-line accumulation of load carriers 10-1, 10-2, and 10-3. The carrier supporting track 12 is represented by the solid line; the power track 14 (and power means) by the dash line; and if the leading carrier 10-1 is stopped (as by a conventional stopping device), the driving dogs of the following carriers 12-2 and 12-3 will be successively disengaged from the power means by operation of the disengaging lever 25 on their respective front trolleys by the actuating means 26 on the preceding rear trolleys 22. The spacing of accumulated load carriers is detirmined by the distance between the front and rear trolleys 20 and 22; that distance in turn depends on the spacing between the suspension members 28 and 30, or, in other words on the length of the load 52 carried between the suspension members by the load supporting means 46.

Figure 4:
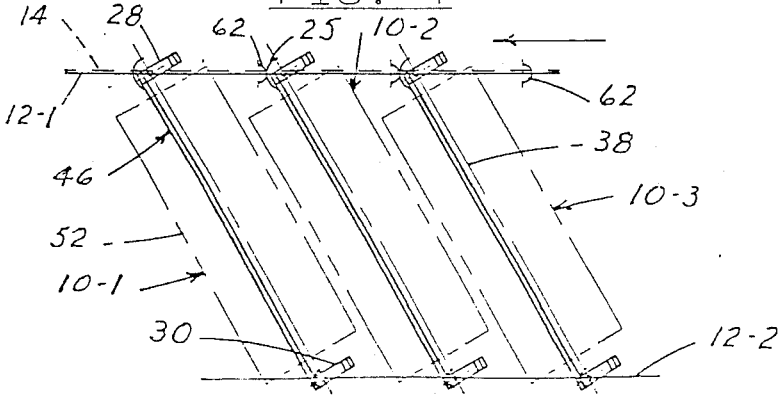
FIG. 4 is a schematic plan view showing load carriers of FIGS. 1 and 2 in side-by-side accumulated relation.

For a power and free conveyor in which it is desired to transport loads in side-by-side relation, each carrier 10 is provided with an idler trolley 58(FIG. 1) connected to the front trolley 20 by a tow bar 60 intermediate the front and rear trolleys 20 and 22 and equipped with intermediate actuating means 62. Such a conveyor, as shown in FIG. 4, includes a portion having first and second parallel carrier supporting tracks 12-1 and 12-2 spaced apart transversely a distance less than the longitudinal distance between the front trolley 20 and the rear trolley 22 of each load carrier 10. The first of the parallel carrier supporting tracks 12-1 is adapted to support the front trolley 20 and the idler trolley 58 of each load carrier 10 and is arranged in vertically spaced relation with the power track 14; the second of the parallel tracks 12-2 supports the rear trolley 22 of each load carrier 10. Successive load carriers 10-1, 10-2 and 10-3 accumulate one behind the other from the operation of the driving dog disengaging lever 25 on the front trolley of a following load carrier 10-2 and 10-3 by the intermediate actuating means 62 on the idler trolley 58 a leading load carrier 10-1 and 10-2. The spacing between side-by-side accumulated carriers is detirmined by the longitudinal distance between the front trolley 20 and the idler trolley 58 of each load carrier 10 as established by the length of the tow bar 60. The installation of a sanitary drip pan 54 under each of the parallel tracks 12-1 and 12-2 is made possible by the offset configuration of the front and rear suspension members 28 and 30 of the load carrier.

I claim:

1. A load carrier for a conveyor having a longitudinally extending track, the load carrier including a front trolley, a rear trolley, and load carrying structure suspended from said front and rear trolleys, said load carrying structure comprising:

a front suspension member, a rear suspension member, connecting means pivotally attaching said front and rear suspension members to the corresponding one of said front and rear trolleys for movement on front and rear vertical axes transversely centered with said track;

each of said front and rear suspension members having an upper portion extending transversely of said track to the same side of a vertical plane through said vertical axes, a vertical portion extending downwardly from said upper portion in oblique intersecting relation with said vertical plane, said vertical portion terminating in a lower end;

and load supporting means connecting the lower end of said front suspension member to the lower end of said rear suspension member, said load supporting means being positioned at least in part on the side of said vertical plane opposite to the upper portions of said suspension members such that the center of gravity of said load carrying structure lies substantially in said vertical plane.

2. A load carrier according to claim 1 wherein said load supporting means comprises a longitudinal member connected to and extending between the lower ends of said front and rear suspension members, and load supports carried by said longitudinal member, said load supports being arranged to position the center of gravity of the load substantially in said vertical plane.

3. A load carrier according to claim 1 wherein said conveyor is a power and free conveyor, said track is a carrier supporting track disposed vertically below a power track supporting power means, said front trolley includes a driving dog and means for disengaging said driving dog from said power means, and said rear trolley includes rear actuating means for operating the disengaging means of the front trolley of a following carrier.

4. A load carrier according to claim 3 wherein a drip pan is mounted below said carrier supporting track and extends longitudinally thereof, said drip pan extending transversely through said vertical plane below the upper portion of each of said front and rear suspension members and having a free longitudinally edge spaced transversely from the vertical portion of each of said front and rear suspension members, and drip pan mounting means connected to said carrier supporting track on the side of said vertical plane opposite to the upper portion of each of said front and rear suspension members.

5. A load carrier according to claim 3 further comprising an idler trolley, a tow bar connecting said idler trolley to said front trolley intermediate said front and rear trolleys, said power and free conveyor includes a portion having first and second parallel carrier supporting tracks, said first track being adapted to support said front and idler trolleys, said second track being adapted to support said rear trolley, and said idler trolley includes intermediate actuating means for operating the disengaging means of the front trolley of a following carrier on said parallel carrier supporting tracks.

6. A load carrier according to claim 5 wherein first and second drip pans are respectively mounted below said first and second carrier supporting tracks and extend longitudinally thereof, said first drip pan extending transversely below the upper portion of said front suspension member and having a free longitudinal edge spaced transversely from the vertical portion of said front suspension member, said second drip pan extending transversely below the upper portion of said rear suspension member and having a free longitudinal edge spaced transversely from the vertical portion of said rear suspension member.

7. A load carrier for a conveyor having a longitudinally extending track, the load carrier including a front trolley, a rear trolley, and load carrying structure suspended from said front and rear trolleys, said load carrying structure comprising:

a front suspension member, a rear suspension member, connecting means pivotally attaching said front and rear suspension members to the corresponding one of said front and rear trolleys for movement on front and rear vertical axes transversely centered with said track;

each of said front and rear suspension members having an upper portion extending transversely of said track to the same side of a vertical plane through said vertical axes, a vertical portion extending downwardly from said upper portion in oblique intersectiong relation with said vertical plane, said vertical portion terminating in a lower end located on the opposite side of said vertical plane; and a longitudinal member connecting the lower end of said front suspension member to the lower end of said rear suspension member, said longitudinal member being positioned relative to said vertical plane such that the center of gravity of said suspension members and said longitudinal member lies substantially in said vertical plane.

8. A load carrier according to claim 7 further comprising load supports carried by said longitudinal member in transversely centered relation with said vertical plane.

9. A load carrier according to claim 7 wherein a drip pan is mounted below said track, said drip pan extending transversely through said vertical plane below the upper portion of each of said front and rear suspension members and terminating in a free end spaced transversely from the vertical portion of each of said front and rear suspension members.

10. A load carrier for a conveyor having a power track supporting power means, and a carrier supporting track spaced vertically from the power track, said load carrier comprising:

a front trolley and a rear trolley mounted on the carrier supporting track, said front trolley having a driving dog and means for disengaging said driving dog from said power means, and said rear trolley having rear actuating means for operating the disengaging means on the front trolley of a following carrier;

load carrying structure connected to and extending between said front and rear trolleys;

an idler trolley; and a tow bar connecting said idler trolley to said front trolley intermediate said front and rear trolley, said idler trolley having intermediate actuating means operable to disengage the driving dog of the front trolley of a following carrier on first and second parallel carrier supporting tracks, said first carrier supporting track being positioned in vertically spaced relation with said power track and being adapted to support the front trolley and the idler trolley of successive carriers with the idler trolley of each carrier positioned in trailing relation to the front trolley of each carrier a distance determined by the length of said tow bar, said second carrier supporting track being adapted to support the rear trolley of successive carriers.

* * * * *